US009757602B2

(12) United States Patent
Brazier

(10) Patent No.: US 9,757,602 B2
(45) Date of Patent: Sep. 12, 2017

(54) FLAME MITIGATION DEVICE AND SYSTEM

(75) Inventor: Geoffrey Brazier, Woodbury, MN (US)

(73) Assignee: BS&B Safety Systems Limited, Limerick (IE)

( * ) Notice: Subject to any disclaimer, the term of this patent is extended or adjusted under 35 U.S.C. 154(b) by 822 days.

(21) Appl. No.: 13/501,996

(22) PCT Filed: Oct. 13, 2010

(86) PCT No.: PCT/US2010/052482

§ 371 (c)(1),
(2), (4) Date: Aug. 31, 2012

(87) PCT Pub. No.: WO2011/047029

PCT Pub. Date: Apr. 21, 2011

(65) Prior Publication Data

US 2012/0312565 A1 Dec. 13, 2012

Related U.S. Application Data

(60) Provisional application No. 61/272,634, filed on Oct. 14, 2009.

(51) Int. Cl.
*A62C 37/36* (2006.01)
*A62C 3/04* (2006.01)
(Continued)

(52) U.S. Cl.
CPC ..... *A62C 37/36* (2013.01); *A62C 3/04* (2013.01); *A62C 3/06* (2013.01); *A62C 99/00* (2013.01)

(58) Field of Classification Search
CPC ..... A62C 35/605; A62C 13/22; A62C 35/023; A62C 99/0027; A62C 5/002; A62C 35/60;
(Continued)

(56) References Cited

U.S. PATENT DOCUMENTS 3,871,458 A * 3/1975 Dumazet ..... A62C 3/04 169/45
4,487,266 A * 12/1984 Gillis et al. ..... 169/51
(Continued)

FOREIGN PATENT DOCUMENTS

CN 2133372 Y 5/1993
EP 0 559 968 A1 9/1993
WO WO 2008/118260 A2 10/2008

OTHER PUBLICATIONS

International Search Report from the European Patent Office for International Application No. PCT/US2010/052482, mailed Mar. 10, 2011.

(Continued)

*Primary Examiner* — Arthur O Hall
*Assistant Examiner* — Juan C Barrera
(74) *Attorney, Agent, or Firm* — Finnegan, Henderson, Farabow, Garrett & Dunner, LLP

(57) ABSTRACT

A flame mitigation device (26), along with associated systems and methods, is disclosed. More particularly, a flame mitigation device (26) has at least one sensor (25) configured to sense a flame (21), and at least one suppression agent (28) release device configured to release a flame suppression agent into the projected flame path when the flame is sensed. The sensor (25) may sense the flame either directly or indirectly. A flame mitigation system (26) is also disclosed, wherein the system includes an enclosure (22) and at least one pressure release device configured to release a flame from the enclosure. The system (26) may include at least one sensor (25) configured to sense the flame (21), and a device configured to release a suppression agent (28). A method of mitigating a flame in a combustible material system is also disclosed.

24 Claims, 9 Drawing Sheets

(51) Int. Cl.
*A62C 3/06* (2006.01)
*A62C 99/00* (2010.01)

(58) Field of Classification Search
CPC .... A62C 3/08; A62C 4/00; A62C 4/02; A62C 4/04; A62C 37/36; A62C 37/38; A62C 37/40; A62C 37/42; A62C 37/44; A62C 3/04; A62C 3/06; A62C 99/00
USPC ..... 169/5, 6, 7, 8, 9, 11, 15, 19, 20, 21, 41, 169/23, 60, 69, 61; 454/169
See application file for complete search history.

(56) References Cited

U.S. PATENT DOCUMENTS

| | | | | |
|---|---|---|---|---|
| 4,978,947 | A | 12/1990 | Finnegan | |
| 5,069,291 | A * | 12/1991 | O'Connell | 169/66 |
| 5,486,811 | A * | 1/1996 | Wehrle | G08B 17/00 169/23 |
| 6,178,983 | B1 | 1/2001 | Culliinane et al. | |
| 6,446,653 | B2 | 9/2002 | Cullinane et al. | |
| 6,598,454 | B2 | 7/2003 | Brazier et al. | |
| 6,792,964 | B2 | 9/2004 | Farwell et al. | |
| 6,889,774 | B2 * | 5/2005 | Multer | B05B 1/262 169/37 |
| 7,070,003 | B1 * | 7/2006 | Smith | 169/66 |
| 7,168,333 | B2 | 1/2007 | Brazier et al. | |
| 2002/0117312 | A1 * | 8/2002 | Snoeys et al. | 169/60 |
| 2004/0065449 | A1 * | 4/2004 | Brooker | 169/46 |
| 2005/0235584 | A1 | 10/2005 | Farwell | |
| 2007/0181183 | A1 | 8/2007 | Farwell et al. | |
| 2008/0017393 | A1 * | 1/2008 | Whitney | 169/60 |
| 2009/0000406 | A1 | 1/2009 | Brazier et al. | |
| 2009/0189773 | A1 | 7/2009 | Hansen et al. | |

OTHER PUBLICATIONS

Third Notification of Office Action, Chinese Application No. 201080054970.X (Jun. 3, 2015) (7pages) and English-language translation (11 pages) (18 pages total).
Decision of Rejection, Chinese Application No. 201080054970.X (Feb. 2, 2016) (5 pages) and English-language translation (7 pages) (12 pages total).
Notification of Reexamination, Chinese Application No. 201080054970.X (Nov. 15, 2016) (8 pages) and English-language translation (3 pages) (11 pages total).

* cited by examiner

FLAME MITIGATION DEVICE AND SYSTEM

CROSS-REFERENCE TO RELATED APPLICATIONS

This application claims the benefit of U.S. Provisional Application No. 61/272,634, filed Oct. 14, 2009, by Geoffrey Brazier, and titled FLAME BALL MITIGATION DEVICE AND SYSTEM, the disclosure of which is hereby expressly incorporated herein by reference.

FIELD OF THE DISCLOSURE

This disclosure generally relates to flame mitigation devices and associated systems and methods. More specifically, this disclosure relates to mechanisms by which a flame quenching agent may be delivered into the path of a flame to reduce its severity.

BACKGROUND

A fire or explosion can result from ignition of a combustible material, such as dust, gas, or vapor, when mixed with oxygen present in the environment. When such ignition takes place within a process or storage enclosure, or other system, the rapid rise in pressure developed may exert destructive forces within a few milliseconds, which may place both personnel and equipment at risk.

A number of industries may face the danger of ignition in an enclosed system, including plastics, food and dairy, pigments and dyes, wood processing, grain processing, coal processing, pharmaceuticals, grain ethanol, chemicals, metals, and agrochemicals. Within and/or beyond those industries, particular applications may pose the danger of such ignition. For example, cyclones, bag houses, cartridge filters, pneumatic conveying systems, milling processes (including pin milling, ball milling, etc.), bucket elevators, dryers, ovens, roller mills, grinding applications, and buildings may all pose the danger of ignition causing fire or explosion.

The destructive forces associated with an explosion may take the form of a detonation (i.e., an expanding flame that proceeds at a speed in excess of the speed of sound in air) or a deflagration (i.e., an expanding flame that proceeds below the speed of sound in air). In a detonation or deflagration, the destructive forces travel at high speeds, rendering typical fire mitigation technologies ineffective. In a detonation or deflagration, a flame may be released from the system in a dynamic manner; therefore, the flame may take any number of shapes. For example, the flame may be released in the form of a generally expanding conical shape as it moves away from the enclosure. The present disclosure may be used with any shape of flame. In general, a flame being released from the system may be referred to as a "flame ball," and it may be illustrated figuratively as a circular shape. The term "flame ball"; however, is not restricted to any particular (e.g., spherical or round) geometry, regardless of how the flame is illustrated.

Most materials handling, processing, and storage equipment is not designed to resist the pressure of an explosion. To survive a deflagration, for example, processing and storage equipment typically must be designed to resist the maximum pressure ($P_{max}$) developed by the combustion process. Such design may be prohibitively expensive, however, because $P_{max}$ may exceed 75 psig (5.2 bar) in typical cases. Therefore, to address combustion, a process or storage enclosure may be provided with a pressure release device, an explosion venting system, flame arrestor system, or flameless venting system, which will allow the pressure and/or a flame of an explosion to escape the enclosure. Alternatively, a process or storage enclosure may be provided with an explosion suppression system designed to prevent an explosion from occurring. These and other explosion protection/prevention measures are described generally in the text below. Known explosion protection/prevention measures include, for example, the commercially available explosion suppression and chemical isolation systems offered by BS&B Safety Systems. Exemplary BS&B systems include the BS&B Explosion Venting IQR System™; the BS&B Spark Detection & Extinguishing ("SDE") Systems; and various BS&B explosion vents, including the VSB™, VSP™ VSS™, VSE™, EXP™, EXP/V™, EXP/DV™, LCV™, HTV™ vents.

An explosion venting system provides a pressure release device or an explosion vent as part of the process or storage enclosure. The explosion vent may include an explosion panel, such as those described in co-owned U.S. Pub. Nos. 2005/0235584 and 2007/0181183, the contents of each of which are hereby expressly incorporated by reference in their entirety. An explosion vent may also be provided with a rupture disk, such as those described in co-owned U.S. Pat. Nos. 6,792,964, 6,178,983, and 6,446,653, the contents of each of which are hereby incorporated by reference in their entirety. Pressure release devices and explosion vents are described throughout the present disclosure. Principles of the disclosure may be used with any mechanism by which the effects of an explosion may be vented or released from a system.

Combustion within the enclosure may create an increased pressure (i.e., overpressure), which in turn can lead to opening of the pressure release device or explosion vent. When an explosion vent opens, a flame may be released from the enclosure. The flame may be released directly to the atmosphere. Alternatively, if the pressure release device or explosion vent is deployed within a building or structure, a duct may be used to direct the flame away from the enclosure, e.g., to the exterior of the building or structure. An explosion or pressure venting system may do little to mitigate a flame, a pressure wave, or particulates resulting from the combustion.

FIG. 1 illustrates a flame being emitted from an enclosure by way of an explosion venting system. The exemplary enclosure illustrated in FIG. 1 is a cylindrical dust collector; however, the present disclosure comprehends any number of other process or storage enclosures, including enclosures open, at least in part, to the environment. As discussed above, a combustion may lead to the opening of a vent through which a flame may be emitted. FIG. 1 illustrates a point in time after the vent 3 has opened and while a flame 1 is being emitted. As shown in FIG. 1, the flame 1 has a reach R. In one application, a flame may have a reach of up to 20 feet. In another application, a flame may have a reach of up to 100 feet or more. The flame 1 may have a dynamic shape, with an expanding diameter D, which may expand to around half of the reach R. Although the term "diameter" is used, and the flame is depicted in FIG. 1 as being round, the disclosure is not limited to flames having a circular or other round cross-section. As illustrated in FIG. 1, the flame 1 poses a safety hazard to both personnel and equipment within its reach R. The temperature of a typical flame can reach in excess of 1000 degrees Fahrenheit within a fraction of a second—too hot for human survival and too fast for personnel to remove themselves from harm.

A flame arrestor is a passive flame mitigation device, which may be provided as part of the process or storage enclosure. A flame arrestor may be comprise a component such as a coiled-ribbon-type mesh, woven metallic mesh, or ceramic matrix, which is designed to provide a small flow path. When the flame passes through the small flow path, it tends to be suppressed or extinguished. A flame arrestor is typically deployed in a combustible gas or vapor application. A flame arrestor may provide effective mitigation of a flame, thereby acting as a barrier to the flame's progress. As the size of the enclosure is increased, the flame arrestor must also be increased. Thus, for large enclosures, a flame arrestor is typically a heavy device requiring a significant amount of space for installation. Flame arrestors may also require extensive maintenance. The flame arresting components (e.g., mesh) must be maintained in clean condition. Built-up process material on the arresting components may impair performance. For that reason, flame arrestors may not be suitable for use in a dusty environment, which may cause blockage of the flame arresting components—resulting in a reduced flow rate capability and reduced heat absorption capability. In addition, passive flame mitigation devices, like flame arrestors, might not completely extinguish a flame.

A flameless venting system provides a combination of an explosion vent and a flame arrestor, and is designed to absorb the flame arising from combustion. Depending on the design of the flameless venting device, it may mitigate the flame, reduce a pressure pulse emitted by the combustion, and absorb some or all of the particulates arising from, e.g., a combustible dust explosion. A flameless venting system suffers from similar drawbacks as a flame arrestor system: it may be heavy, require a large amount of space for installation, and must be maintained clean from material buildup. In addition, a flameless venting system may require significant refurbishment or even replacement after exposure to a flame (i.e., after activation).

An explosion suppression system does not require the opening of any venting devices in a process or storage enclosure. An explosion suppression system is provided with a device to prevent the full development of an explosion, thereby preventing formation of a flame and associated pressure rise that would otherwise need to be released to the environment. Such a device may include an explosion suppression agent release device, which can release or inject an explosion suppression agent into the enclosure. Explosion suppression systems may be costly. Moreover, an explosion suppression system may rely on numerous suppression agent injection points, which multiply the cost. In addition, an explosion suppression system may not eliminate the potential for a flame to be emitted. Particularly where the process or storage enclosure is open to the environment, a flame may be emitted despite the activation of an explosion suppression system.

In light of the foregoing, there is a need for a flame mitigation system, which reduces the severity of a flame resulting from an explosion, while reducing cost. The flame mitigation system of the present disclosure achieves these, or other, advantages.

SUMMARY

To attain one or more of the above or other advantages, as embodied and broadly described herein, the disclosure is directed to a flame mitigation device for a combustible material system having a projected flame path, external to the system, for a flame to be released from the system in the event of an explosion. The device comprises at least one sensor configured to sense a flame in the event of an explosion, and at least one suppression agent release device configured to release a flame suppression agent into the projected flame path when the flame is sensed.

The disclosure is also directed to a flame mitigation system comprising an enclosure and at least one pressure release device configured to release a flame from the enclosure in the event of an explosion, the pressure release device having an outlet side. The system comprises at least one sensor configured to sense the flame, and a suppression agent release device oriented on the outlet side of the pressure release device, the suppression release device configured to release a flame suppression agent into the path of the flame when the flame is sensed.

In another aspect, the disclosure is directed to a method of mitigating a flame in a combustible material system, comprising sensing a flame in an enclosure in the event of an explosion and releasing a flame suppression agent into a projected path of the flame.

BRIEF DESCRIPTION OF THE DRAWINGS

The accompanying drawings, which are incorporated in and constitute a part of this specification, illustrate several embodiments and together with the description, serve to explain principles of the disclosure.

DESCRIPTION OF THE EMBODIMENTS

Reference will now be made in detail to the present exemplary embodiments, examples of which are illustrated in the accompanying drawings.

Figure 1:
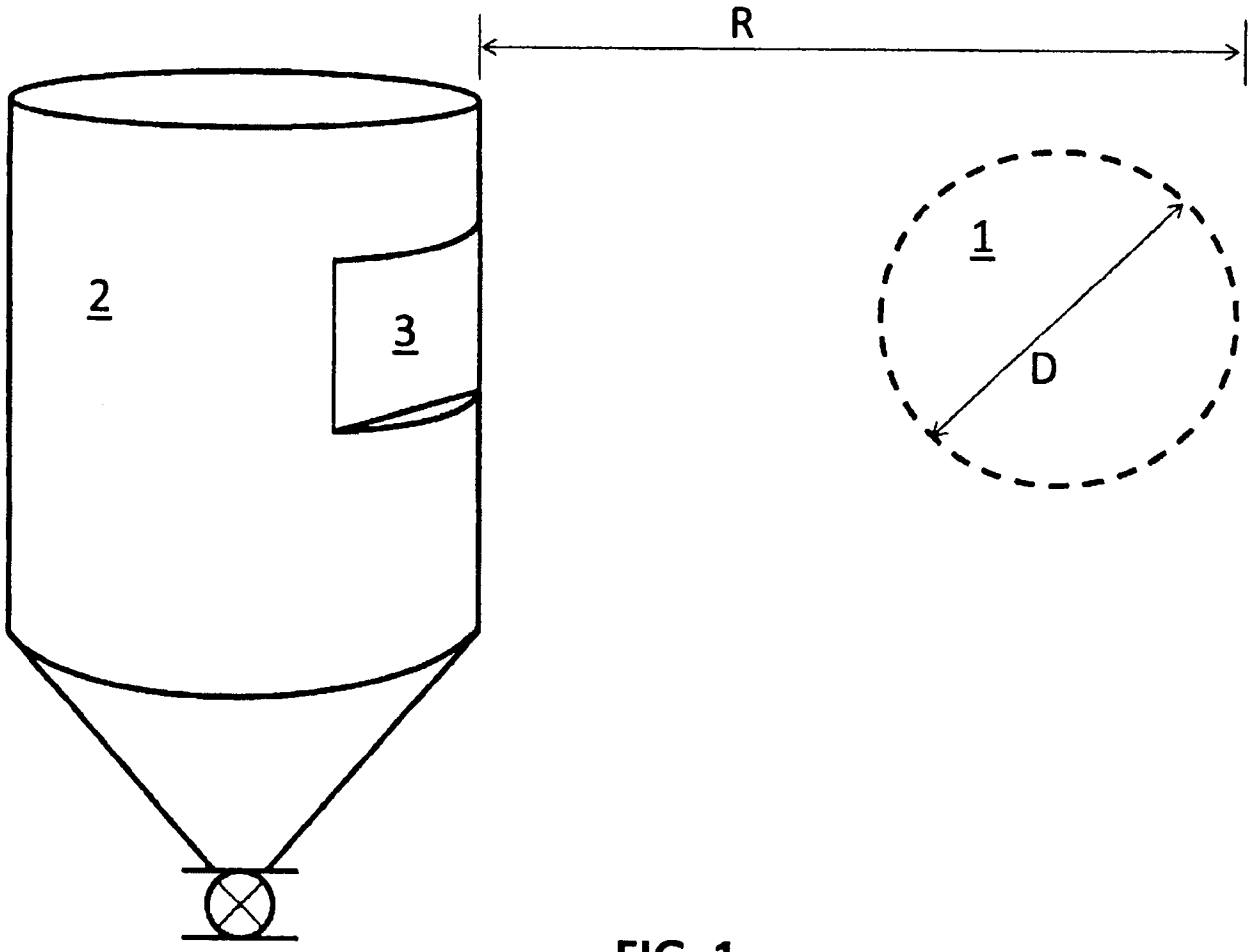
FIG. 1 PRIOR ART
FIG. 1 illustrates a known explosion venting system.
Figure 2B:
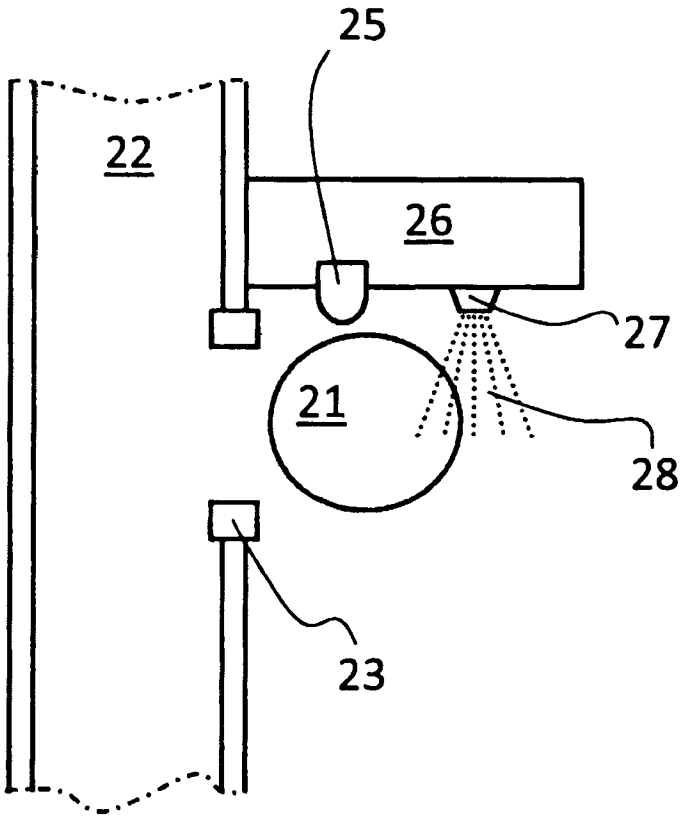
FIGS. 2A-2B illustrate a flame mitigation system according to an embodiment of the disclosure, wherein a flame sensor is placed near a quenching agent release point.
Figure 2A:
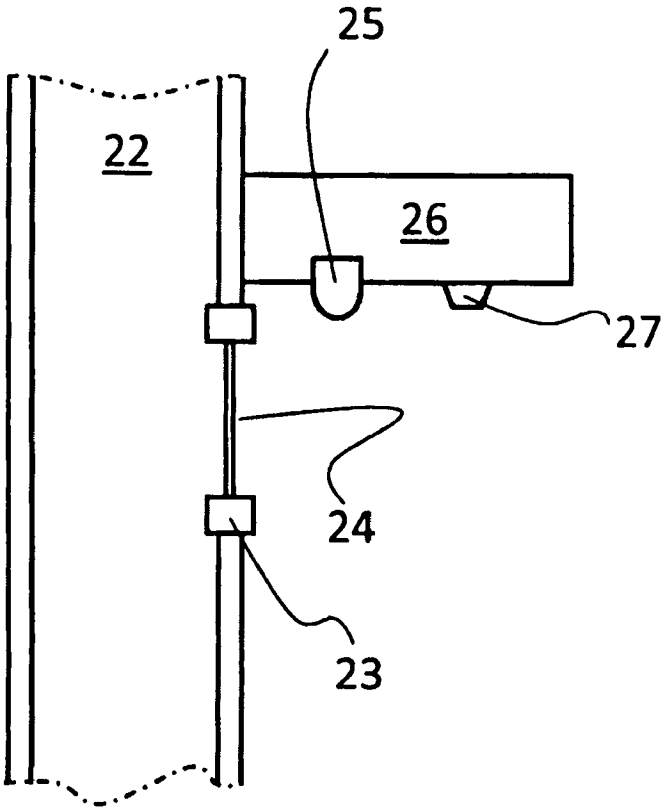

A flame mitigation system according to one embodiment is illustrated in FIGS. 2A-2B. As shown in FIG. 2A, an enclosure 22 is provided with a pressure release device 23, which may be an explosion vent. The pressure release device 23 has an activation portion 24. Activation portion 24 is configured to activate—i.e., release pressure—in response to an overpressure situation within enclosure 22. To activate, activation portion 24 may, for example, be destroyed, ruptured, or ejected.

A flame mitigation device 26 may be provided. As illustrated in FIGS. 2A-2B, flame mitigation device 26 may be mounted on enclosure 22. It is comprehended, however, that flame mitigation device 26 may be positioned separate from enclosure 22. Flame mitigation device 26 is provided with a quenching agent release point 27. Although the quenching agent release point 27 is illustrated in the shape of a nozzle 27, the quenching agent release point may take the form of any suitable device releasing, delivering, or injecting a quenching or suppressing agent. Moreover, although a single release point 27 is shown, multiple release points may be used.

Figure 9:
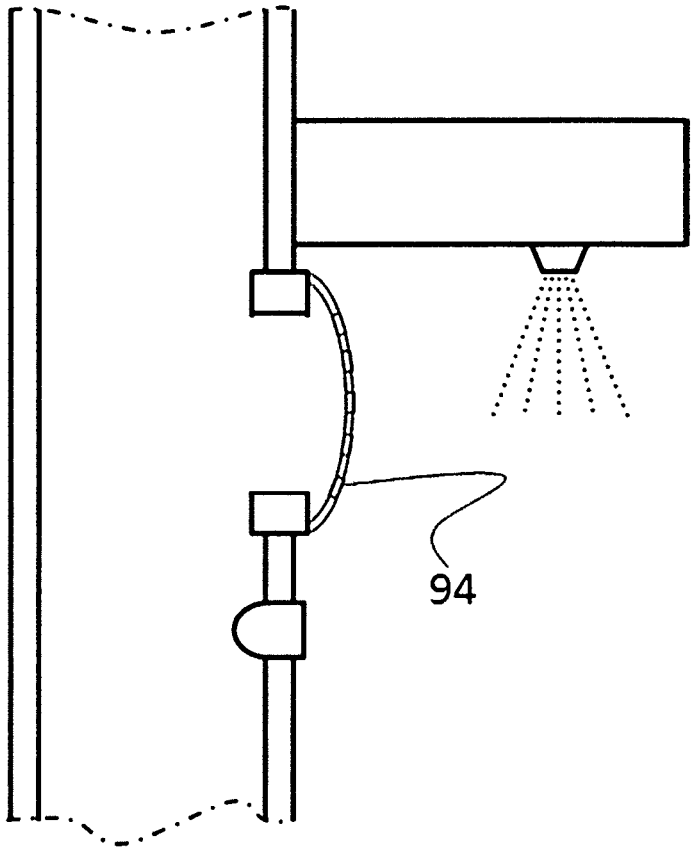
FIG. 9 illustrates the use of a passive flame mitigation device according to an embodiment of the disclosure.

When an overpressure situation is reached within enclosure 22, activation portion 24 may activate, allowing a flame 21 to escape from pressure release device 23. Although the flame 21 is figuratively illustrated as a circle (in FIG. 2B, as well as other figures of the disclosure), the disclosure is not limited to circular-shaped flames. When the flame 21 approaches quenching agent release point 27, a quenching agent 28 may be released into the path of the approaching flame 21. In this manner, the flame mitigation device may be considered to be an "active" flame mitigation device. In one embodiment, the "active" flame mitigation device may be used instead of or in addition to a "passive" flame mitigation device (94, as illustrated in FIG. 9), such as a flame arrestor in the form of a coiled-ribbon-type mesh, woven metallic mesh, or ceramic matrix.

By releasing a quenching agent 28 into the path of an approaching flame, the flame may be mitigated in any number of ways. For example, the quenching agent may tend to reduce one or more of the following or other deflagration characteristics: size of the flame, duration of the flame, volume occupied by the flame, temperature around the flame, and/or force arising from the flame (e.g., a pressure wave that may accompany a dust or gas deflagration condition).

As illustrated in FIGS. 2A-2B, flame mitigation device 26 may be provided with a sensor 25. The sensor 25 may be placed at or in the proximity of the quenching agent release point 27 as illustrated. As illustrated in FIG. 2B, sensor 25 may configured to sense the approaching flame as it approaches quenching agent release point 27. Upon sensing the approaching flame, sensor 25 may cause the flame mitigation device 26 to release the quenching agent 28 into the path of the approaching flame 21.

The sensor 25 illustrated in FIGS. 2A and 2B may be any suitable sensor for sensing the approaching flame 21. The sensor 25 may indirectly sense the flame. For example, the sensor 25 may be a temperature sensor. Alternatively or in addition, the sensor 25 may also sense other phenomena coexisting with the flame. For example, the sensor 25 may be a pressure sensor configured to sense a pressure wave that may precede the arrival of the flame 21. During the earlier stages of a combustion event, a pressure wave may move ahead of the propagating flame. Thus, the flame may be detected indirectly by sensing that pressure wave. Sensing the pressure wave may allow early detection of an impending flame. Such early detection can provide a number of benefits. For example, early detection allows for the use of a slower—and potentially lower cost—quenching agent release mechanism. Early detection also may allow a relatively larger volume to be filled with quenching agent before the flame arrives, potentially allowing the quenching agent to be more effective. In addition, early detection may allow the sensor and quenching agent release point to be positioned relatively close to one another, while still leaving enough time to disperse sufficient quenching agent. Minimizing the distance between the sensor and quenching agent release point may be beneficial, because it can allow the flame mitigation system to be used in smaller systems.

As another option, the sensor can directly sense the flame. For example, the sensor 25 may be an optical or infrared sensor configured to sense the approach of flame 21. In one embodiment, sensor 25 may comprise a mechanical activation component placed in the pathway of the flame 21. In such an embodiment, the flame 21 may physically trip sensor 25. The sensor 25 may be located external to the system. Alternatively, the sensor 25 can be placed within the system. In one embodiment, the effects of a deflagration on components in the system may be sensed or measured, and those effects may be used in place of or in addition to any other sensor. Thus, the sensor may be placed in the equipment being protected. Any number of sensors may be used.

The quenching agent 28 may be any suitable agent for quenching a flame. For example, quenching agent 28 may be a dry powder agent (e.g., sodium bicarbonate), liquid agent (e.g., water), heated liquid agent (e.g., pressurized water that will flash to steam upon release from release point 27), a foam or foaming agent, or a gaseous agent (e.g., carbon dioxide, nitrogen). In addition, it is comprehended that the quenching agent 28 may be a combination of multiple quenching agents.

The quantity of quenching agent 28 to be released may be uniquely selected for each application of a flame mitigation system. Quenching agent quantity will be a function of a number of system parameters. In one embodiment, the amount of quenching agent 28 to be released may depend on a characteristic measured by sensor 25 (e.g., energy within the enclosure 22, pressure, light, or infrared radiation) or another sensor (not shown) configured to sense a characteristic of the atmosphere. Greater quantities of quenching agent 28 can be released to achieve greater levels of flame mitigation. Larger pressure release/vent areas may require larger volumes of quenching agent 28 to be released. Similarly, if multiple pressure release devices or pressure relief areas are provided, then multiple release points 27 (and larger volumes of quenching agent 28) may be required. The volume of enclosure 22 may also dictate the amount of quenching agent 28 to be used in a flame mitigation system. Typically, greater volume enclosures require greater volumes of quenching agent. Finally, the reactivity of the material within enclosure 22 may dictate the volume of quenching agent 28 required. Reactivity is commonly expressed by a deflagration index—$K_{st}$ for dust and $K_g$ for vapor or gas. A more reactive material (i.e., higher $K_{st}$ or $K_g$) may require a greater volume of quenching agent 28.

Figure 3B:
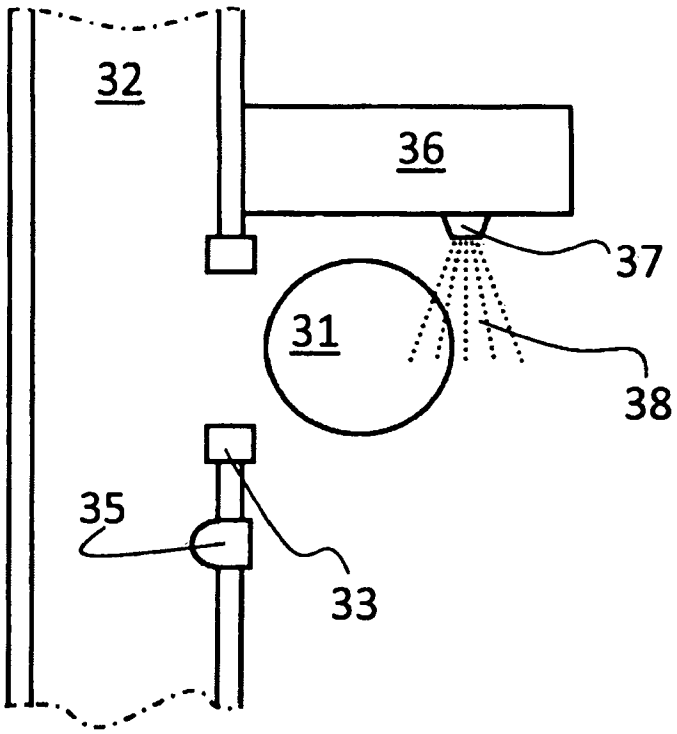
FIGS. 3A-3B illustrate a flame mitigation system according to an embodiment of the disclosure, wherein a flame sensor is placed within the enclosure in which an explosion occurs.
Figure 3A:
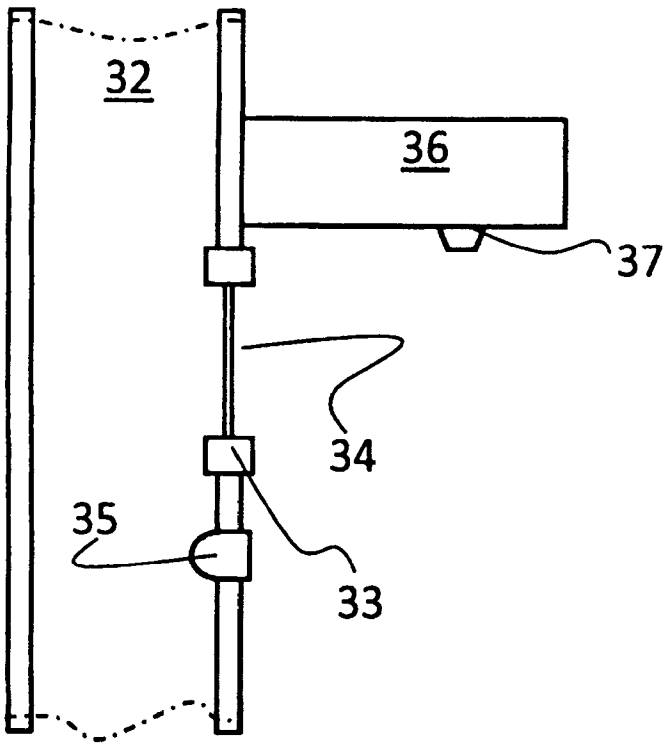

Another embodiment of a flame mitigation system is illustrated in FIGS. 3A-3B. As illustrated in FIGS. 3A-3B, an enclosure 32 may be provided with a pressure release device 33, which may be a vent, having an activation portion 34. A sensor 35 may be configured to sense a parameter within the enclosure 32. For example, sensor 35 may be configured to sense energy within the enclosure 32, pressure, visible light, infrared radiation, or any other characteristic indicating that a flame is or will be developing within the enclosure 32. According to FIGS. 3A-3B, a flame mitigation device 36 having an quenching agent release point 37 also may be provided.

According to the embodiment of FIGS. 3A-3B, the sensor 35 may sense that a flame is or will be developing within the enclosure 32. Sensor 35 may then cause the flame mitigation device 36 to release a quenching agent 38 into the path of flame 31.

As configured in FIGS. 3A-3B, a flame mitigation system may detect a flame developing within enclosure 32 before activation portion 34 is activated. Accordingly, quenching agent 38 may be released into the path of the flame 31 before it is released from the system. Alternatively, the flame mitigation device may wait to release quenching agent 38 until sometime after a developing flame is detected by sensor 35.

Figure 4B:
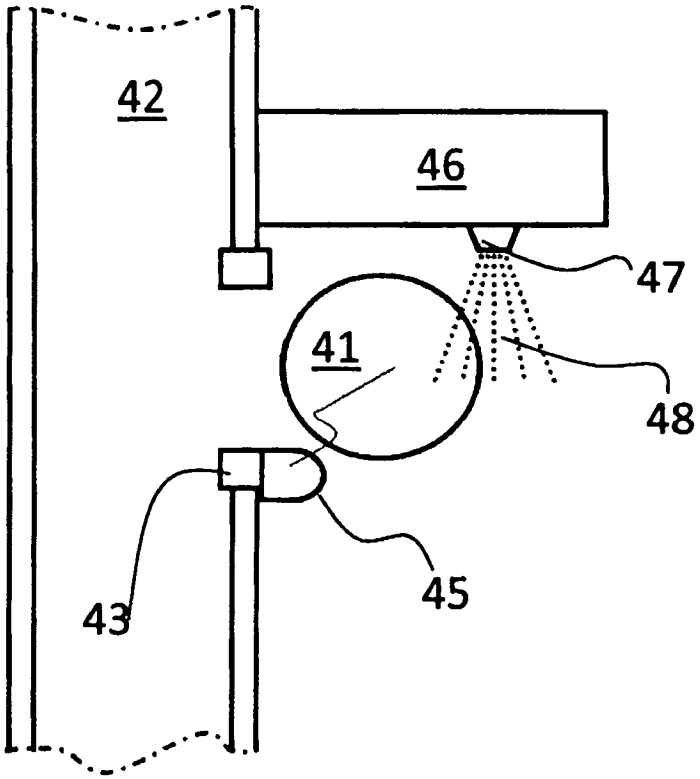
FIGS. 4A-4B illustrate a flame mitigation system according to an embodiment of the disclosure, wherein a sensor is configured to sense when a pressure release device is activated.
Figure 4A:
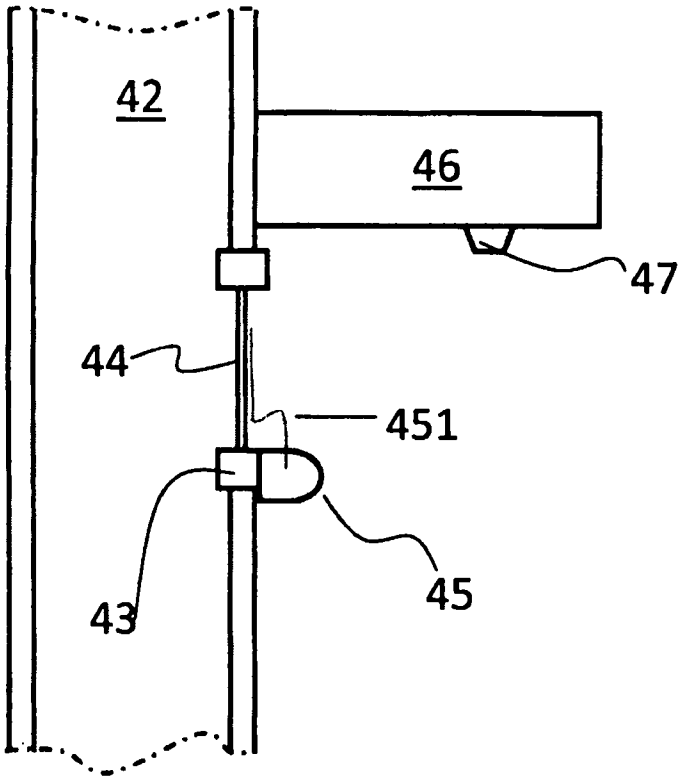

An additional embodiment of a flame mitigation system is illustrated in FIGS. 4A-4B. As illustrated in FIGS. 4A-4B, an enclosure 42 may be provided with a pressure release device 43, which may be a vent, having an activation portion 44. A sensor 45 may be provided to sense activation of activation portion 44. As illustrated in FIGS. 4A-4B, sensor 45 is provided with a wire 451. When activation portion 44 activates, wire 451 may be broken or otherwise disturbed, thereby indicating to sensor 45 that the activation portion 44 has activated. For example, wire 451 may have a current traveling through it before activation portion 44 is activated. Thus, when wire 451 is broken, the current may be interrupted, indicating to sensor 45 that the activation portion has activated. The sensor 45 may then cause flame mitigation device 46 to release a quenching agent 48 into the path of flame 41 via release point 47.

Although sensor 45 is illustrated as using a wire 451 to sense activation of activation portion 451, the disclosure is not limited to this embodiment. Sensor 45 may also sense activation by way of a magnetic sensor, optical sensor, or pressure sensor. Suitable sensors for sensing activation of activation portion 44 may include the commercially available BS&B Safety Systems Vis-U-Tec™ Sensor and MBS™ Sensor. Additional suitable sensors for sensing activation of activation portion 44 are disclosed, for example, in co-owned U.S. Pat. Nos. 4,978,947 and 6,598,454, the contents of each of which are hereby expressly incorporated by reference in their entirety.

Figure 5B:
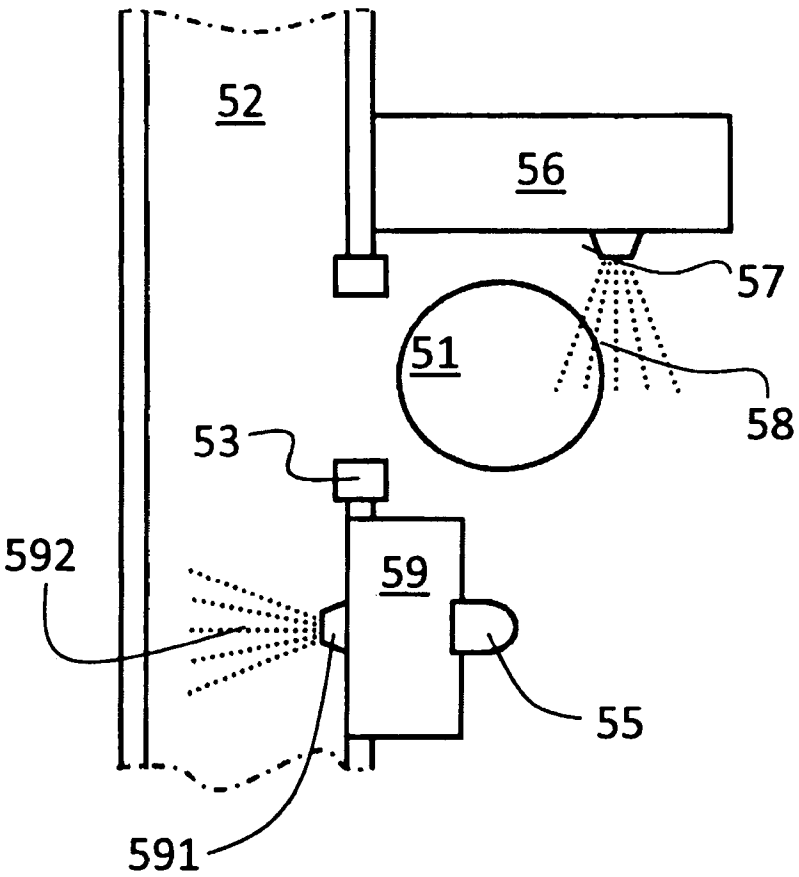
FIGS. 5A-5B illustrate a flame mitigation system according to an embodiment of the disclosure, wherein the flame mitigation system is installed in a system including an explosion suppression system.
Figure 5A:
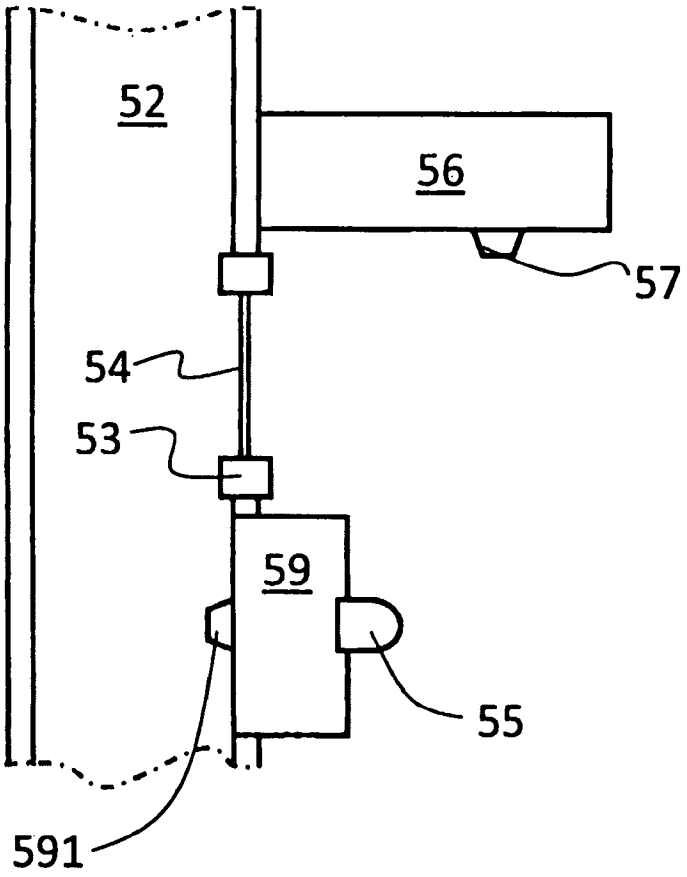

Another embodiment of a flame mitigation system is illustrated in FIGS. 5A-5B. As illustrated in FIGS. 5A-5B, an enclosure 52 may be provided with a pressure release device 53, which may be a vent, having an activation portion 54. The enclosure 52 may also be provided with an explosion suppression system 59. Explosion suppression system 59 may include an release point 591 configured to release an explosion suppression agent 592 into the enclosure 52. An exemplary explosion suppression system is described in co-owned U.S. Pub. No. 2009/0189773, the contents of which are hereby expressly incorporated by reference in their entirety.

A sensor 55 may be provided to sense when explosion suppression system 59 is activated—i.e., when explosion suppression system 59 releases an explosion suppression agent 592 from release point 591 into enclosure 52. Upon sensing activation of explosion suppression system 59, sensor 55 may signal for flame mitigation system 56 to release a quenching agent 58 into the path of flame 51 from release point 57.

Figure 6:
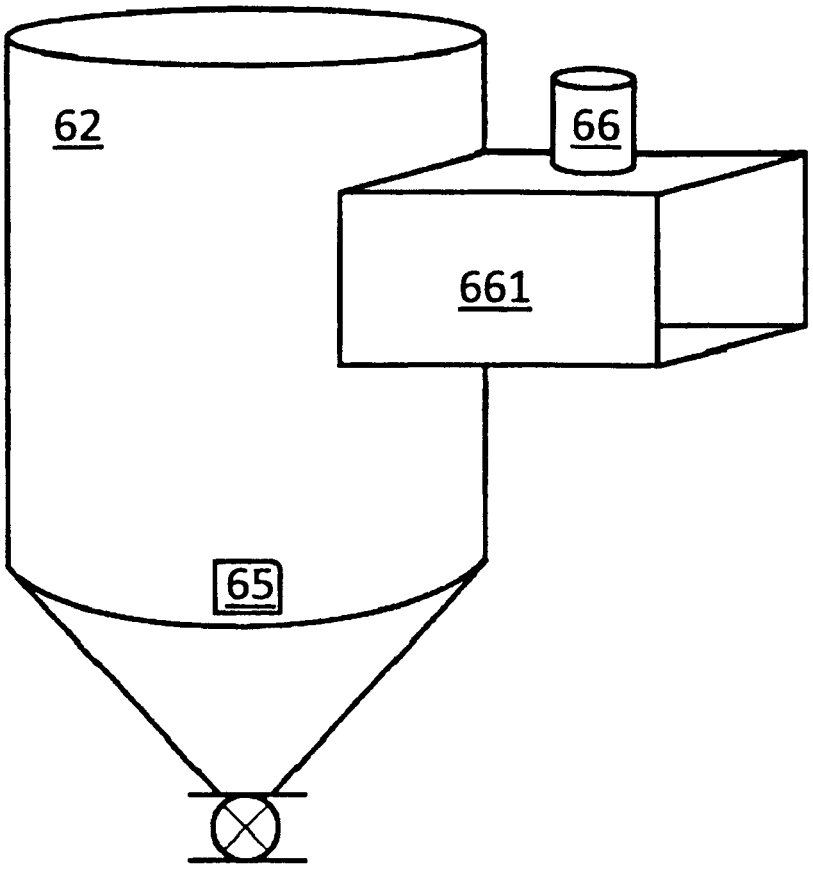
FIG. 6 is a perspective view of a flame mitigation system including a duct, according to an embodiment of the disclosure.
Figure 7:
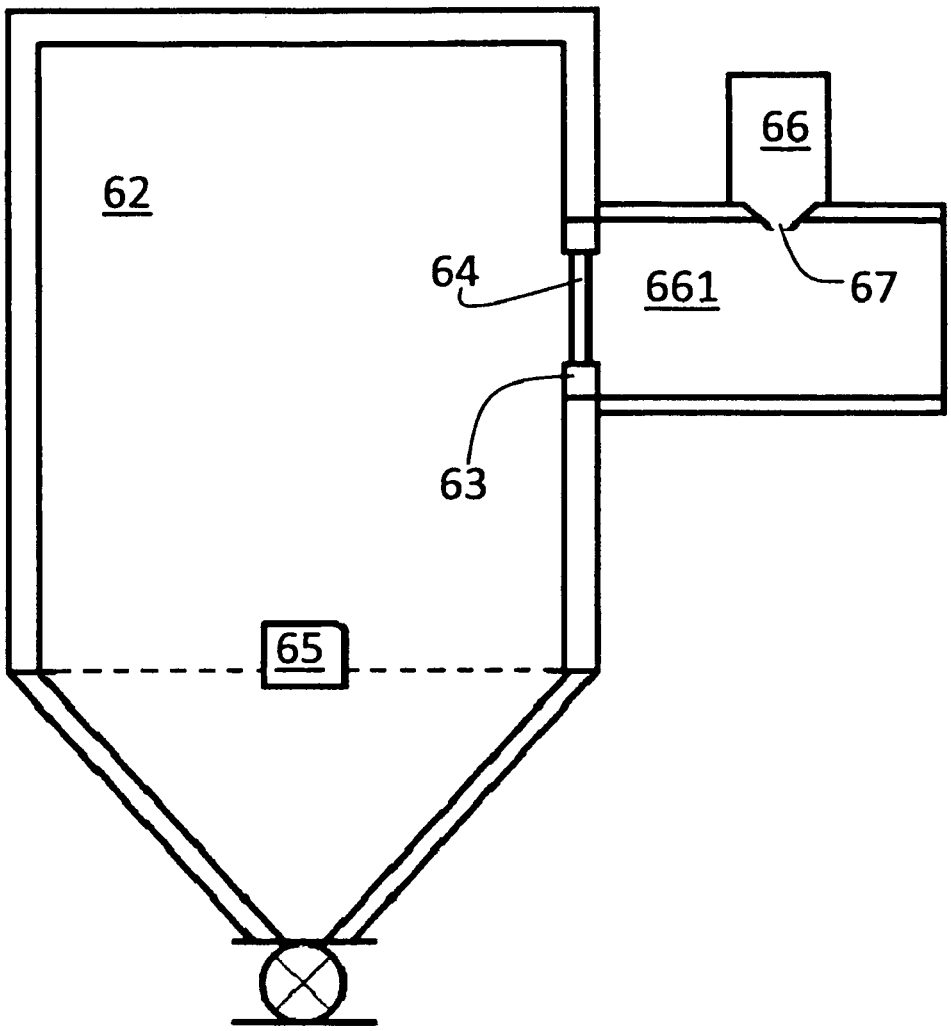
FIG. 7 is a cross-sectional view of the flame mitigation system of FIG. 6.

Yet another embodiment of a flame mitigation system is illustrated in FIGS. 6 and 7. As shown in FIG. 6, a duct 661 may be provided on the outlet side of a pressure release device 63, which may be a vent, having an activation portion 64 (best shown in FIG. 7) in an enclosure 62. Although enclosure 62 is illustrated as a cylindrical dust collector, the disclosure is not limited to such a structure. Accordingly, the enclosure 62 may be any process or storage enclosure for processing, handling, and/or storing dust, vapor, and/or gas.

Duct 661 may be used to direct the path of a flame emitted from enclosure 62. Additionally, duct 661 may be used to enhance the functionality of a flame mitigation device 66 provided on the duct. In some applications, atmospheric conditions (e.g., strong winds) may lead to rapid dispersion of a quenching agent released by a flame mitigation device. In other applications, atmospheric conditions may diminish the effectiveness of a quenching agent. For example, rain, hail, or snow might dilute or otherwise adversely affect the performance of a quenching agent. Accordingly, duct 661 may protect a quenching agent from adverse atmospheric conditions. In one embodiment, a sensor (not shown) may be provided to monitor one or more atmospheric conditions. The atmospheric condition sensor may be used to alter the amount of quenching agent to be released, depending on the atmospheric conditions. Such a sensor may also be used in an embodiment without a duct 661.

As illustrated in FIG. 6, sensor 65 may sense a developing or developed flame and trigger flame mitigation device 66 to release a quenching agent into duct 661 by way of release point 67, into the path of the flame. By releasing a quenching agent into duct 661, the flame mitigation system may either reduce the magnitude of the flame or prevent the flame from exiting the duct into the environment. Although the sensor 65 is illustrated as being mounted on enclosure 62, the disclosure is not limited to that embodiment. Accordingly a sensor may be alternatively mounted, for example, in a position similar to those illustrated in FIGS. 2A, 3A, 4A, and 5A. Other aspects of the other embodiments described within this disclosure may also be provided with a flame mitigation system including a duct 661 as illustrated in FIGS. 6-7.

Engineering standards may dictate the design of duct 661. For example, NFPA68-2007, promulgated by the National Fire Protection Association, requires means for calculating the effect of vent ducts placed downstream of explosion vents. A duct may increase the time for an explosion to reach atmospheric conditions, which may lead to a higher developed pressure within the equipment experiencing the explosion (e.g., enclosure 62). These effects may be offset by increasing the cross-sectional area of the vent and/or duct. In one embodiment, duct 661 is provided with a cross-sectional area at least as large as the vent 63 in enclosure 62. Alternatively, these effects may be offset by increasing the pressure rating of the equipment experiencing the explosion (e.g., enclosure 62). According to the present disclosure, releasing a quenching agent into the path of a flame may also be effective to mitigate these effects.

Although FIGS. 6-7 illustrate a duct, the disclosure may also be used in a system that does not include a duct (as illustrated, for example, in FIGS. 2A-5B and 8A-8D). A ductless system may provide cost savings through elimination of a duct. Additionally, a ductless system may avoid a time delay associated with releasing a deflagration through a duct. Such a delay can lead to undesirable buildups in pressure, which may be avoided if a duct is not used. Such increased pressures are described, for example, in NFPA 68-2007 Chapter 7.4 and Chapter 8.5. In a non-ducted system, an agent release device may be positioned external to the system, configured to release a suppression agent into the projected path of the flame.

The present disclosure may be applied to retrofit existing combustible material systems to have a flame mitigation system. For example, an agent release device may be positioned external to the existing system, in the projected path of the flame. The agent release device may be positioned external to an existing ducted or ductless system. The agent release device may be positioned external to an existing pressure release device or vent.

In operation, a flame mitigation system according to the present disclosure has been demonstrated to substantially mitigate a flame emitted from an enclosure. A 100 cubic-foot vessel and a 32-inch nominal diameter explosion vent of low-inertia design (plastic film) was first provided without a flame mitigation system according to the present disclosure. A corn starch explosion generated within the vessel created a 12-foot diameter flame reaching 32 feet of horizontal trajectory from the vent. The same vessel was then provided with a flame mitigation device according to the present disclosure, which was configured to release sodium bicarbonate quenching agent into the flame emerging from the vent. By using a flame mitigation device according to the present disclosure, the flame diameter was reduced to 5 feet, and the horizontal reach of the flame was reduced to less than 10 feet. Other flame mitigation results may be achieved by implementing the various other embodiments of the present disclosure.

A flame mitigation system according to the present embodiment may release a quenching agent into the pathway of a flame at any number of suitable trajectories as illustrated, for example, in FIGS. 8A-8D. The trajectory of a quenching agent may be selected, for example, in view of the particular characteristics of the process or storage enclosure and/or the material subject to explosion.

Figure 8A:
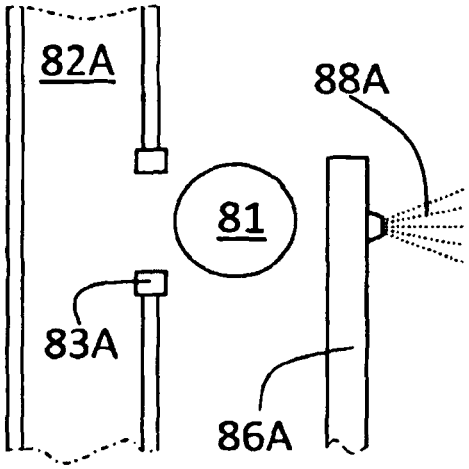
FIG. 8A illustrates a flame mitigation system configured to release a quenching agent axially away from a developing flame.

As illustrated in FIG. 8A, a quenching agent 88A may be released from flame mitigation device 86A away from a flame 81 along the flame's projected axis of travel. Thus, when a flame 81 is released from an enclosure 82A by way of a pressure release device (e.g., vent 83A), it may encounter a quenching agent 88A being released in the flame's direction of travel.

Figure 8B:
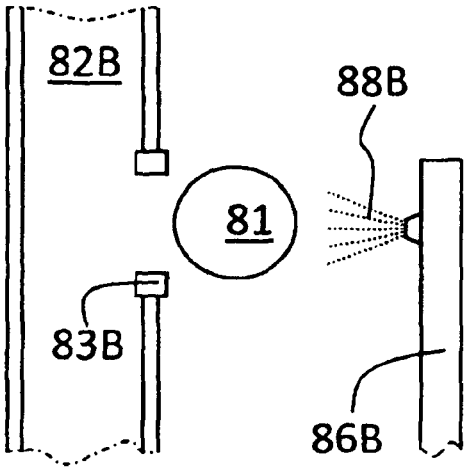
FIG. 8B illustrates a flame mitigation system configured to release a quenching agent axially towards a developing flame.

As illustrated in FIG. 8B, a quenching agent 88B may be released from flame mitigation device 86B directly into the flame 81 along the flame's projected axis of travel. Thus, when a flame 81 is released from an enclosure 82B by way of a pressure release device (e.g., vent 83B), it may encounter a quenching agent 88B being released directly into and against the flame's direction of travel.

Figure 8C:
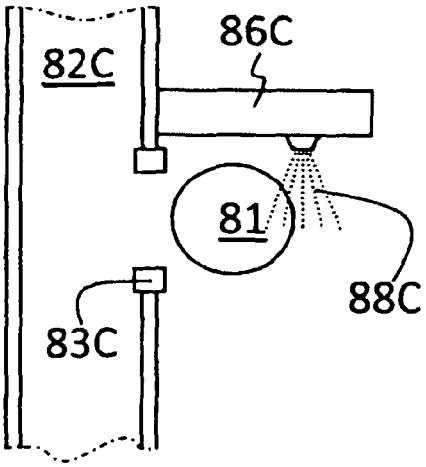
FIG. 8C illustrates a flame mitigation system configured to release a quenching agent perpendicular to the axis of travel of a developing flame.

As illustrated in FIG. 8C, a quenching agent 88C may be released from flame mitigation device 86C perpendicular to the axis of travel of flame 81. Thus, when flame 81 is emitted from enclosure 82C by way of a pressure release device (e.g., vent 83C), it may encounter a quenching agent being released perpendicular to the flame's direction of travel.

Figure 8D:
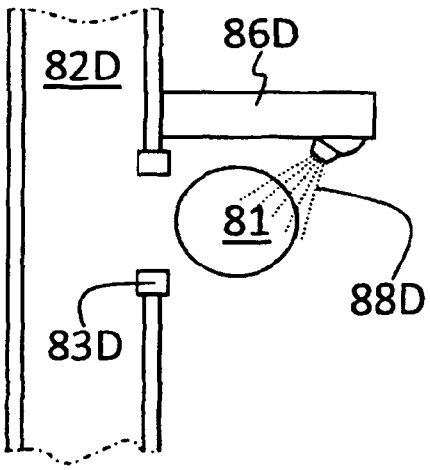
FIG. 8D illustrates a flame mitigation system configured to release a quenching agent oblique to the axis of travel of a developing flame.

The embodiments discussed to this point have disclosed a quenching agent being released either parallel or perpendicular to a flame's direction of travel. The present disclosure is not limited to that arrangement, however. In one embodiment, as illustrated in FIG. 8D, a quenching agent 88D may be released from flame mitigation device 86D obliquely into or along the path of flame 81. Thus, when flame 81 is emitted from enclosure 82D via a pressure release device (e.g., vent 83D), it may encounter a quenching agent being released from any suitable direction. In one embodiment, the direction of quenching agent release may be dictated by a characteristic sensed by a sensor (not shown). For example, the direction of quenching agent release may depend on the size or temperature of a flame. Additionally or alternatively, the direction of quenching agent release may depend on one or more atmospheric conditions, such as for example, wind speed, rain, hail, or snow.

In addition to the direction of quenching agent release, it may be desirable to select the spray pattern of a released quenching agent. For example, a release point may be configured to emit a wider or narrower spray pattern depending on the anticipated size of flame or any other suitable parameter. In one embodiment, the spray pattern may be dictated by a characteristic, e.g., of the enclosure or atmosphere, sensed by a sensor (not shown).

By selecting the direction and pattern of quenching agent release, an operator may also direct a quenching agent into an area outside of the direct path of a flame. For example, a quenching agent may be released into an area/volume in which a flame might otherwise expand. By controlling release of a quenching agent in such a manner, an operator may thus control the expansion of a flame without necessarily quenching the flame.

Because the safety of a flame mitigation system may depend on the condition of its components, in one embodiment, a monitoring device may optionally be provided to monitor one or more such conditions. For example, a monitoring device (not illustrated) may be provided to supervise the condition of the quenching agent, agent release device(s), sensor(s), vent(s), and/or vent activation portion(s). Additionally or alternatively, a monitoring device may be provided to monitor one or more conditions inside or outside of the equipment experiencing an explosion. Such a monitoring devices are disclosed, for example, in co-owned U.S. Pat. No. 7,168,333 and U.S. Pub. No. 2009/0000406, the contents of each of which are hereby incorporated by reference in their entirety. A monitoring device may generate an alarm or other warning to alert a user as to an operating condition of the flame mitigation system and/or the equipment experiencing an explosion.

While the above described embodiments of a flame mitigation system have been depicted as using a vent with a substantially flat activation portion, the disclosure is not intended to be limited to this particular structure. Therefore, alternative flame mitigation systems are intended to be within the scope of this disclosure, including all equivalent vents and pressure release devices, such as domed rupture disks. Additionally, while the above described embodiments of a flame mitigation system have been depicted as releasing a suppression agent in response to a signal from a sensor, the disclosure is not intended to be limited to any particular structure connecting the sensor to a flame mitigation device and/or suppression agent release point. Thus, while the sensor may be directly connected to the flame mitigation device and/or suppression agent release point, the sensor may alternatively connect to a CPU or other device, which in turn connects to the flame mitigation device and/or suppression agent release point. Accordingly, a signal from the sensor may be interpreted by the CPU, which may then trigger the flame mitigation device to release a suppression agent. Furthermore, the connections between sensor, flame mitigation device, suppression agent release point, and/or CPU, may be wireless. It is also contemplated that the present disclosure need not be limited to applications involving a flame "ball." Rather, the concepts of the present disclosure may be used to mitigate other results of combustion, ignition, and/or pressure venting, including flames that propagate in different patterns and dust or vapor clouds that may not necessarily combust. Additionally, it is contemplated that individual features of one embodiment may be added to, or substituted for, individual features of another embodiment. Accordingly, it is within the scope of this disclosure to cover embodiments resulting from substitution and replacement of different features between different embodiments.

The above described embodiments and arrangements are intended only to be exemplary of contemplated systems and methods. Other embodiments will be apparent to those skilled in the art from consideration of the specification and practice of the disclosure herein.

What is claimed is:

1. A flame mitigation device for a combustible material system having a projected flame path for a flame to be released from the system in the event of an explosion, comprising:

at least one sensor configured to sense a flame and generate a signal in the event of an explosion;

at least one duct configured to direct the path of a flame in the event of an explosion;

at least one pressure release device configured to release a flame from the duct into the external environment, the pressure release device having an outlet side; and at least one suppression agent release device oriented on the outlet side of the pressure release device, the suppression agent release device configured to release a flame suppression agent into the projected flame path in response to the signal from the at least one sensor.

2. The flame mitigation device of claim 1, wherein the at least one sensor is configured to sense the flame directly.

3. The flame mitigation device of claim 2, wherein the at least one sensor comprises at least one of an optical sensor, infrared sensor, or mechanical trip sensor.

4. The flame mitigation device of claim 1, wherein the at least one sensor is configured to sense the flame indirectly.

5. The flame mitigation device of claim 4, wherein the at least one sensor comprises at least one of a temperature sensor or a pressure sensor.

6. The flame mitigation device of claim 4, wherein the at least one sensor comprises a sensor configured to sense a pressure wave moving ahead of the flame.

7. The flame mitigation device of claim 1, wherein the suppression agent comprises at least one of a dry agent, a liquid agent, a foam agent, or a gaseous agent.

8. The flame mitigation device of claim 1, wherein the combustible material system comprises an enclosure containing a combustible material, and wherein the flame mitigation device is positioned external to the enclosure.

9. The flame mitigation device of claim 1, further comprising an explosion suppression system.

10. The flame mitigation device of claim 1, further comprising a passive flame mitigation device.

11. A flame mitigation system, comprising:

an enclosure;

at least one pressure release device configured to release a flame from the enclosure via a ductless outlet in the event of an explosion, the pressure release device having an outlet side;

at least one sensor configured to sense the flame, the at least one sensor further configured to generate a signal upon sensing the flame; and a suppression agent release device oriented on the outlet side of the pressure release device, the suppression agent release device configured to release a flame suppression agent into the path of the flame in response to the signal generated by the at least one sensor.

12. The flame mitigation system of claim 11, wherein the at least one sensor is further configured to sense a condition within the enclosure.

13. The flame mitigation system of claim 11, wherein the at least one sensor is further configured to sense the effects of the flame on one or more components of the system.

14. The flame mitigation system of claim 13, wherein the at least one sensor is further configured to sense a temperature of one or more components of the system.

15. The flame mitigation system of claim 13, further comprising:

an explosion suppression system;

wherein the at least one sensor is further configured to sense the effects of the flame on the explosion suppression system.

16. The flame mitigation system of claim 11, wherein the at least one sensor is positioned between the pressure release device and the agent release device.

17. The flame mitigation system of claim 11, wherein the at least one sensor is further configured to sense an activation of the pressure release device.

18. The flame mitigation system of claim 11, further comprising:

an explosion suppression system configured to suppress an explosion within the enclosure.

19. The flame mitigation system of claim 18, wherein:

the at least one sensor is further configured to sense when the explosion suppression system is activated.

20. A method of mitigating a flame in a combustible material system, comprising:

sensing a flame in an enclosure in the event of an explosion and generating a signal;

identifying a projected path of the flame based on a sensed characteristic of the flame; and releasing a flame suppression agent in response to the signal into the projected path of the flame before the flame reaches the projected path; wherein the projected path is external to the enclosure.

21. The method of claim 20, wherein sensing a flame further comprises sensing one or more of visible light, infrared radiation, temperature, or pressure.

22. The method of claim 20, wherein sensing a flame further comprises tripping a mechanical sensor in response to the flame.

23. The method of claim 20, wherein releasing a flame suppression agent further comprises releasing a flame suppression agent into the enclosure.

24. The method of claim 20, wherein the projected path of the flame extends outside of the enclosure, and wherein releasing a flame suppression agent further comprising releasing a flame suppression agent into the projected path of the flame outside of the enclosure.

* * * * *